US010617248B2

(12) United States Patent
Hale

(10) Patent No.: US 10,617,248 B2
(45) Date of Patent: Apr. 14, 2020

(54) LIGHT SYSTEM AND METHOD FOR LIGHTING A TREE

(71) Applicant: William Hale, Cumming, GA (US)

(72) Inventor: William Hale, Cumming, GA (US)

(73) Assignee: Wintergreen Corporation, Alpharetta, GA (US)

( * ) Notice: Subject to any disclaimer, the term of this patent is extended or adjusted under 35 U.S.C. 154(b) by 0 days.

(21) Appl. No.: 16/160,962

(22) Filed: Oct. 15, 2018

(65) Prior Publication Data

US 2019/0110625 A1 Apr. 18, 2019

Related U.S. Application Data

(60) Provisional application No. 62/573,123, filed on Oct. 16, 2017.

(51) Int. Cl.

| | |
|---|---|
| ***A47G 33/04*** | (2006.01) |
| ***A47G 33/08*** | (2006.01) |
| ***F21V 23/00*** | (2015.01) |
| ***F21V 23/06*** | (2006.01) |
| *F21W 121/04* | (2006.01) |
| *A47G 33/06* | (2006.01) |

(52) U.S. Cl.

CPC ..... *A47G 33/08* (2013.01); *F21V 23/002* (2013.01); *F21V 23/06* (2013.01); *A47G 33/06* (2013.01); *A47G 2033/0827* (2013.01); *F21W 2121/04* (2013.01)

(58) Field of Classification Search

CPC ..... A47G 33/04; A47G 33/06; A47G 33/08; A47G 2033/0827; A47G 2033/122; F21S 4/10; F21S 4/20; F21S 4/22; F21S 4/26; F21S 4/28; F21V 23/002; F21V 23/001; F21V 23/06; F21W 2121/04

See application file for complete search history.

(56) References Cited

U.S. PATENT DOCUMENTS

| | | | | |
|---|---|---|---|---|
| 4,516,193 | A | 5/1985 | Murphy | |
| 8,376,584 | B1 * | 2/2013 | Jenko | F21S 4/15 362/249.18 |
| 2002/0097573 | A1 * | 7/2002 | Shen | A47G 33/06 362/123 |
| 2008/0291662 | A1 * | 11/2008 | Barbieri | A47G 33/06 362/123 |

FOREIGN PATENT DOCUMENTS

| | | | |
|---|---|---|---|
| GB | 2172135 | A | 9/1986 |

* cited by examiner

*Primary Examiner* — Y M. Lee

(74) *Attorney, Agent, or Firm* — Rachel H. Huffstetler; FisherBroyles, LLP

(57) ABSTRACT

A light system having a plurality of lighted tiers wherein each tier includes a plurality of radially extending lighted arms for illuminating branches of a tree. Each lighted arm is operatively associated with at least two conductive connectors for electrically connecting other lighted arms, other lighted tiers, or the lead wire.

9 Claims, 4 Drawing Sheets

LIGHT SYSTEM AND METHOD FOR LIGHTING A TREE

CROSS REFERENCE TO RELATED APPLICATIONS

This application claims the benefit of and priority to U.S. Provisional Patent Application Ser. No. 62/573,123, filed Oct. 16, 2017, the disclosure of which is hereby incorporated by reference.

FIELD OF THE INVENTION

The present invention is directed to a lighting system and, more specifically, to a system of providing connectivity to lights configured to extend axially outward from a power source, such as for lighting branches of a tree, for decorative or other purposes.

BACKGROUND OF THE INVENTION

Decorative lights for illuminating indoor and outdoor structures, such as trees for celebrations or holidays, is commonplace. Originally, this was accomplished by wrapping a structure, such as a tree, with string lights. This system and attendant method, however, are cumbersome to install, remove and store and often results in damaged systems. Providing light strings in linear circuits results in a linear system having extensive length to manipulate and wrap. This results in a large amount of wire to be exposed around the branches, detracting from the decorative appearance of the lighted tree. Indeed, the wire of conventional string lights results in substantial exposed wires around the outer perimeter of the tree.

SUMMARY OF THE INVENTION

It is, therefore, advantageous for a light system which may be easily stored, transported, installed and removed. It is also advantageous to provide a light system which is aesthetically pleasing by obscuring the wires connecting the lights when used to light a tree and its branches. It is also advantageous to have a light system with light strands of manageable length for installment and maintenance. These and other objectives are met by the present invention.

The present invention overcomes shortcomings of the prior art by providing a novel light system including a plurality of lighted tiers in operative connection and at least one lead wire for connecting to a power source to provide power the operatively connected lighted tiers. The lighted tiers each include a plurality of flexible lighted arms extending radially outward from the tier's axial center for lighting the branches of the tree at the preselected tree level. The lighted arms may be linear or comprise multiple light strands. Each lighted arm is operatively associated with at least two conductive couplers for electrically connecting other lighted arms, other lighted tiers, or the lead wire. According to one aspect, the conductive couplers include male and female couplers and one each is connected to each lighted arm. According to another aspect, the couplers are provided as part of the light system and are positioned between adjacent lighted arms and include one or more connection types.

DETAILED DESCRIPTION OF THE INVENTION

The present invention will now be described in detail hereinafter by reference to the accompanying drawings. The invention is not intended to be limited to the embodiments described; rather, this detailed description is provided to enable any person skilled in the art to make and practice the invention.

As used herein, the terms "lateral" and "longitudinal" are used to refer to intersecting directions. The term "fore" refers to the uppermost tier of the light system and term "aft" refers to the bottommost tier of the light system. The term "transverse" direction refers to a direction which intersects the longitudinal or lateral axis, at any angle. The term "radial" refers to a direction transverse to the longitudinal axis. The term "proximal" refers to the end closest to the longitudinal axis and the term "distal" refers to the end remote from the longitudinal axis.

Figure 1:
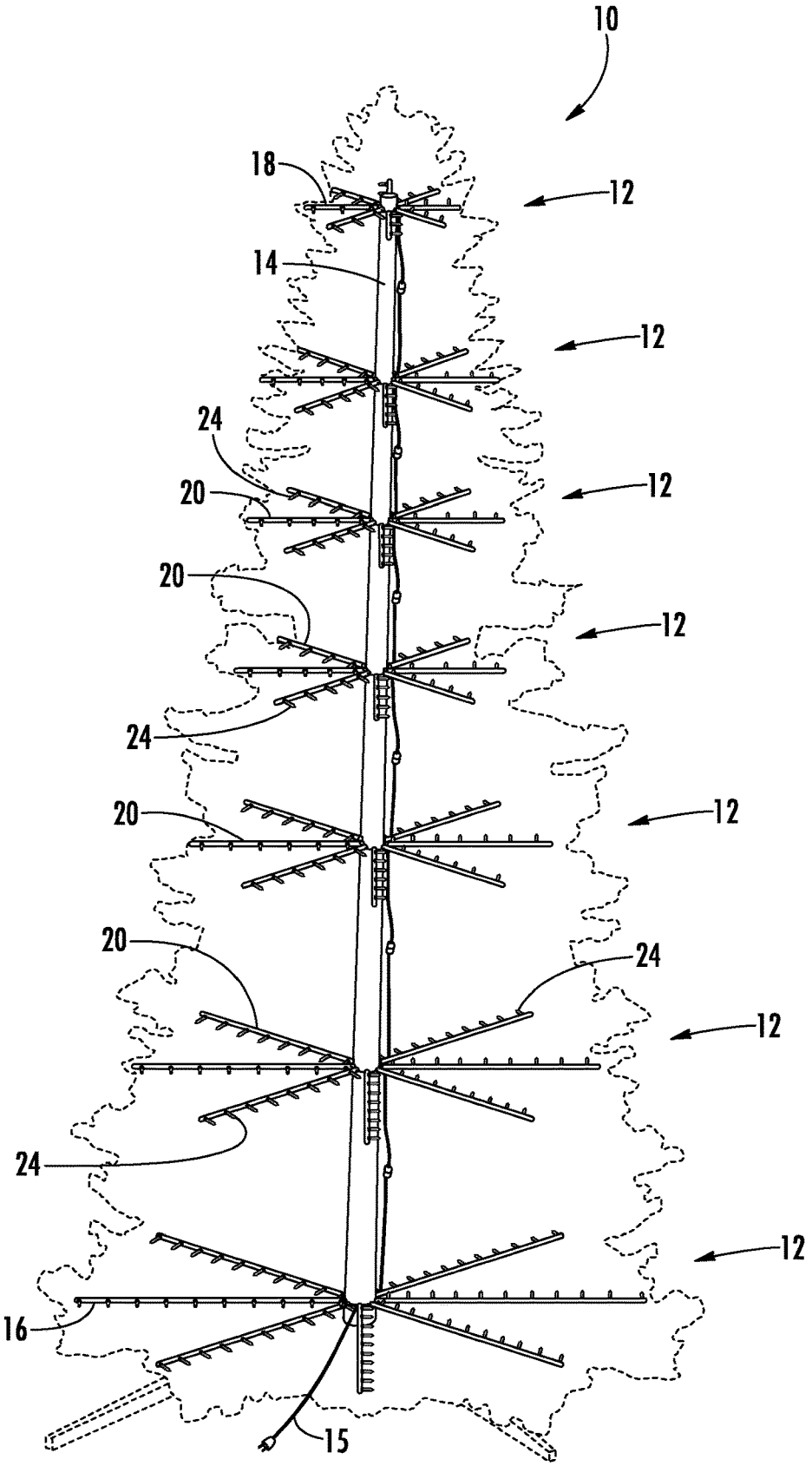
FIG. 1 is a perspective view of a light system positioned on an artificial tree wherein the lighted arms are displayed splayed for illustrative purposes.
Figure 2:
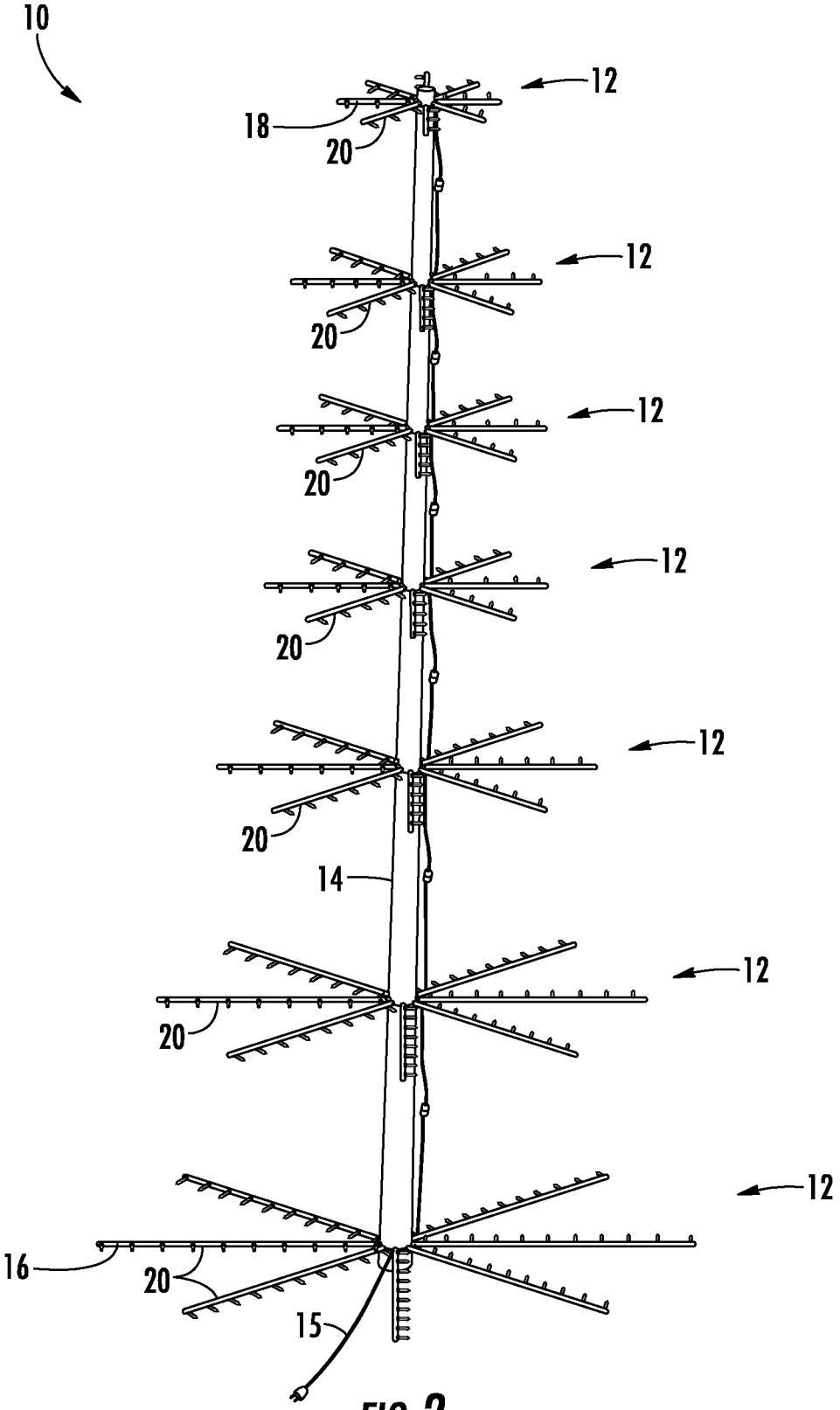
FIG. 2 is a perspective view of the light system on a central pole wherein the lighted arms are displayed splayed for illustrative purposes.

As shown in FIGS. 1 and 2, the light system 10 includes at least one and, as shown, a plurality of lighted tiers 12 longitudinally spaced along the length of a vertical structure, such as a tree pole 14, for example. The lighted tiers 12 extend along a lateral plane. The lighted tiers 12 may be rigidly secured to the tree pole 14 or tree trunk and supported along its length by the tree branches (not shown). The lead wire 15 extends from the light system 10, such as adjacent the aft tier 16. Each lighted tier 12 is electrically connected to the other tiers 12 wherein power is transferred from the lead wire 15 to each tier 12, concluding at the fore tier 18. The fore tier 18 may also be connected to additional lighting structures such as tree top decoration (not shown). As shown, a linear circuit is formed as the lead wire 15 connects to the aft tier 16 and each subsequent tier 12 is connected to the adjacent tier 12. Different circuit configurations are within the scope of the present invention. For example, each tier may connect to the lead wire 15 or more than one lead wire 15 may be provided.

Figure 3A:
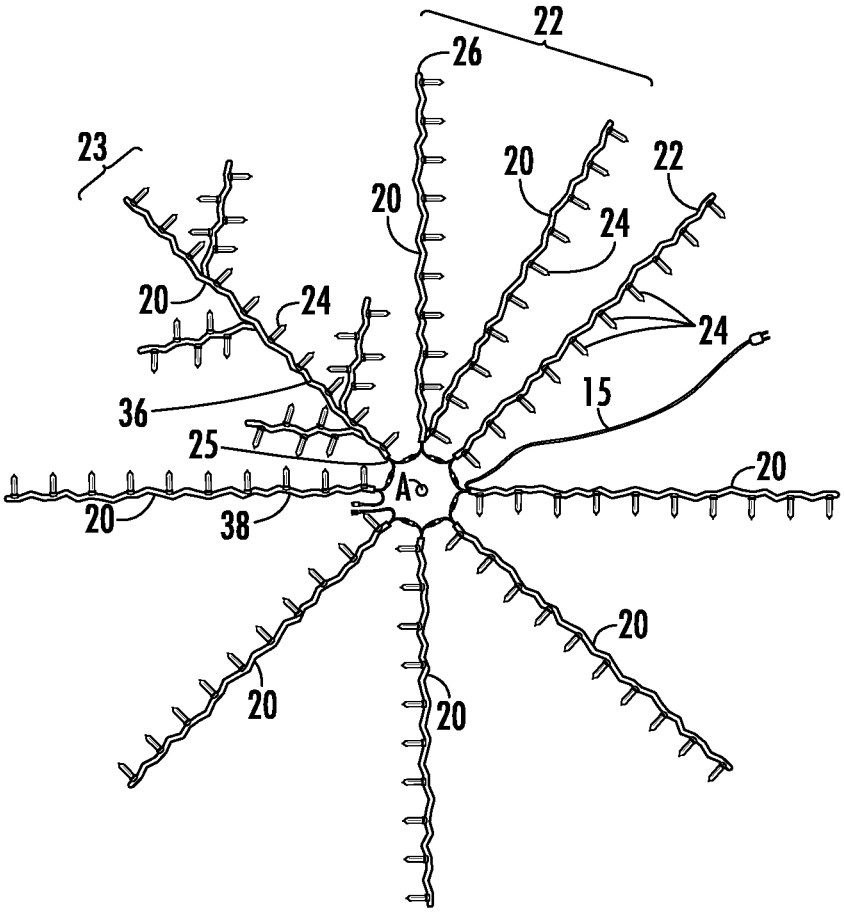
FIG. 3A is top plan view of a lighted tier of the light system.

FIG. 3A illustrates a single tier 12 including at least one, as shown, a plurality, of lighted arms 20 extending in a direction radially outward from the longitudinal axis A of the light system 10 so as to extend in a direction transverse to the axis A. FIGS. 1 and 2 depict the lighted arms 20 schematically or splayed out in a completely stretched, straight position. FIG. 3A depicts the flexible cords defining the lighted arms 20 in a relaxed (that is, not taut) position. As shown, the lighted arms 20 extend outwardly along a plane substantially parallel to the horizontal. The lighted arms may possess varying degrees of rigidity. The lighted arms 20 include conductive flexible cord or wire 22 supporting lights 24 and providing electrical connection thereto. It is to be understood, however, that this is shown as being representative, and the lighted arms may extend transverse to the longitudinal axis A, at any angle. Moreover, the lights 24 be connected to the arm 20 by a wire having a predetermined length not supported immediately adjacent the arm 20. Also, as shown, each lighted arm 20 is shown as a single linear strand of lighted wire. However, one or more lighted arms 20 may be non-liner and may include multiple cord 22 extensions which extend in the same horizontal plane such as cords 22 and 23 shown by way of example in FIG. 3A or in a direction transverse to the horizontal plane.

Figure 3B:
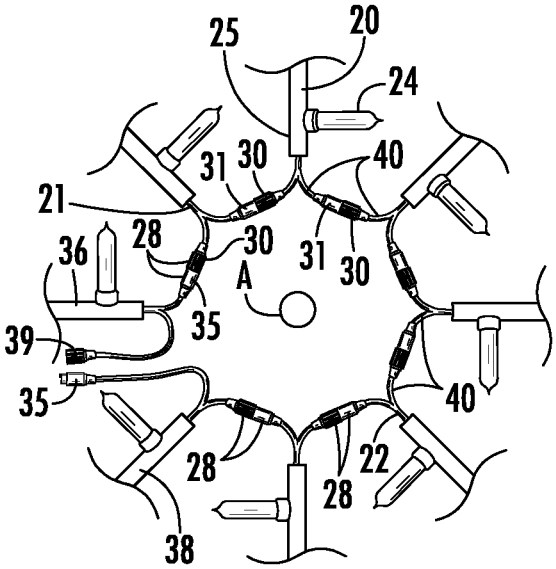
FIG. 3B is an enlarged plan view of FIG. 3A showing the center thereof.

According to one aspect shown in FIGS. 3A and 3B, each lighted arm 20 extends from a proximal end 25 to a distal end 26. The connector or wire 21 adjacent the proximal end 25 includes two couplings 28, each operatively connected to the wire 21 by connection wire 40. According to this aspect, each pair of couplings 28 on each proximal end 25 of each lighted arm 20 includes a male 30 and female 31 couplers as shown in FIGS. 3A and 4.

Figure 4:
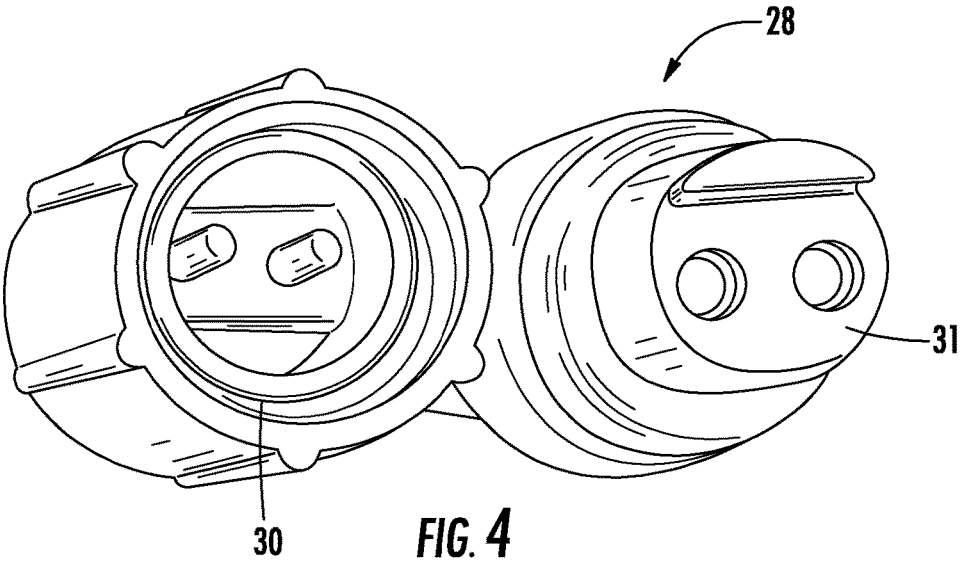
FIG. 4 is a perspective view of couplers according to one aspect.
Figure 5:
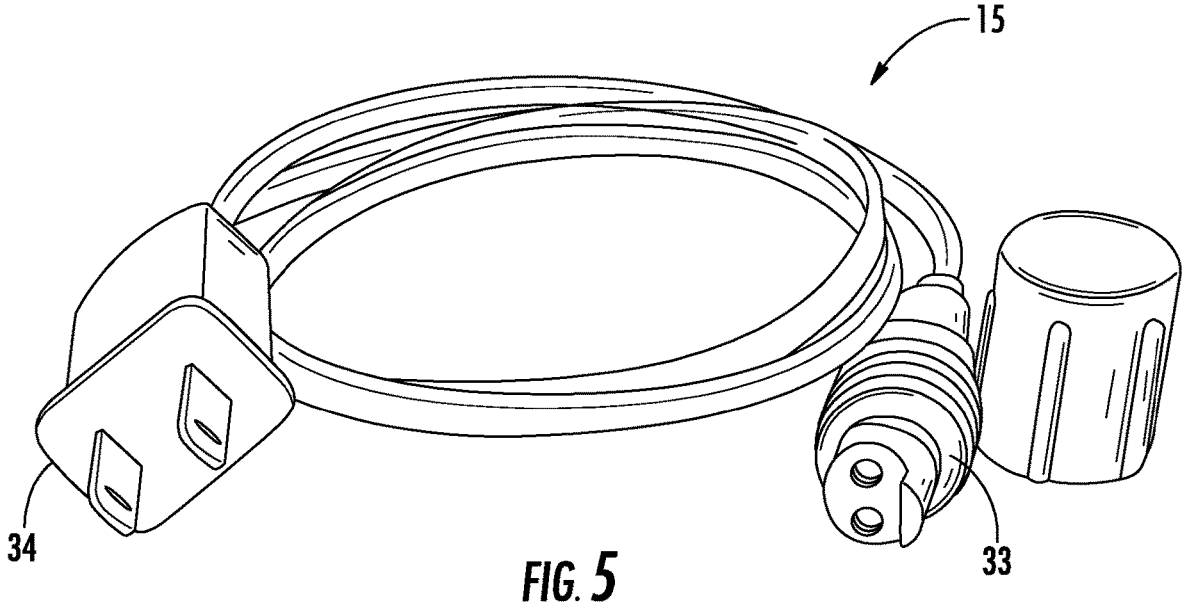
FIG. 5 is a perspective view of a lead wire.

As shown in FIG. 4, the lead wire 15 includes a plug 34 for connecting to a power source and a coupler 33 for operatively connecting to couplings 28 of the lighted arms 20. As shown, the plug 34 is configured for receipt by an electrical outlet. It is envisioned, however, that other power sources, such as battery, solar, etc., may be employed without departing from the scope of this disclosure. As shown, the lead wire connector 33 is a male connector, but any type of coaxial connector may be utilized.

The couplings 28 on each arm 20 as shown include a male 30 and female 31 type connectors. The male 30 and female 31 couplers extend from the proximal end of the wire 22 to define a "Y" configuration of the wires 40 as shown in the various figures. By way of example, the lead wire 15 cooperates with the female connector 35 of a first lighted arm 38. The first female coupler 35 is operatively connected, such as by a coaxial cable, to the male coupler 30 of the first lighted arm 38. The male coupler 30 of the first lighted arm is then connected to the female coupler 31 of the adjacent lighted arm which, in turn is operatively connected to the male coupler 30 of the adjacent arm 20. This continues around the longitudinal axis A until all the couplings 28 are connected in series. The arm 20 adjacent the first lighted arm 36, or the last lighted arm 36, includes a coupler 39 which is not connected to a coupler of an adjacent arm 20 of the same tier 12. This coupler 39 is connected to the first lighted arm 38 of the adjacent tier 12. This continues until each tier 12 is operatively connected to form a closed circuit with the power source.

According to another aspect of the present invention, the couplings 28 are not integrated with the wire 22. The couplings 28 are discrete members having a male and female component for connecting adjacent lighted arms 20. According to another aspect, the couplings 28 are either a male 30 or female 31 couplers and a pair (one of each) are provided between adjacent lighted arms 20.

While exemplary embodiments have been shown and described above for the purpose of disclosure, modifications to the disclosed embodiments may occur to those skilled in the art. The disclosure, therefore, is not limited to the above precise embodiments and that changes may be made without departing from its spirit and scope.

What is claimed is:

1. A lighting system for lighting a tree comprising:

a lead wire configured to operatively connect to a power source;

a first tier comprising a first and second arm wherein one of said first and second arms is operatively connected to said lead wire and wherein each of said first and second arms comprises a proximal and distal end and at least one light supported on said first and second arms between said proximal and distal ends wherein said first and second arms provide power to said at least one light on said first and second arms from said power source;

a second tier comprising a first and second arm, said second tier operatively connected to said first tier and said first and second arms each comprising a proximal and distal end and at least one light supported on said first and second arms between said proximal and distal ends wherein said first and second arms provide power to said at least one light from said power source;

a first tier coupling connected to the proximal end of said first and second arms of said first tier and comprising a first coupler and a second coupler configured to matingly engage with said first coupler wherein said first tier first coupler of said first arm is operatively connected to said lead wire and said first tier second coupler of said first arm is operatively connected to said first tier first coupler of said second arm; and a second tier coupling connected to the proximal end of said first and second arms of said second tier and comprising a first coupler and a second coupler configured to matingly engage with said first coupler wherein said second tier first coupler is operatively connected to said second coupler of said first tier second arm and said second tier second coupler of said first arm is operatively connected to said second tier first coupler of said second arm, wherein power is delivered from said lead wire, to said first tier, and from said first tier to said second tier.

2. The lighting system according to claim 1 wherein said second tier is not directly operatively connected to said lead wire.

3. The lighting system according to claim 1 wherein said first coupler is a female coupler and second coupler is a male coupler.

4. The lighting system according to claim 1 wherein said arm of said first and second tiers supports a plurality of said lights between said proximal and distal ends.

5. The lighting system according to claim 1 wherein at least one of said first and second arms of said first tier is non-linear.

6. The lighting system according to claim 1 wherein at least one of said first and second arms of said second tier is non-linear.

7. The lighting system according to claim 1 wherein said lead wire is configured to transfer electrical power from said power source.

8. A method of lighting a tree comprising the steps of:

providing power to a lead wire;

transferring power from the lead wire to a first tier comprising first and second arms operatively connected to said lead wire, each of said first and second arms comprising a proximal and distal end and at least one light supported on said first and second arms between said proximal and distal ends wherein said first and second arms powers said at least one light;

removeably connecting said first and second arms of said first tier with a first tier coupler comprising a first coupler and a second coupler;

connecting said first and second coupler to connect said first and second arms of said first tier;

transferring power from said first tier to a second tier comprising first and second arms operatively connected to said first tier comprising a proximal and distal end and at least one light supported on said first and second arms between said proximal and distal ends wherein said first and second arms power said at least one light;

removeably connecting said first and second arms of said second tier with a second tier coupler comprising a first coupler and a second coupler;

connecting said first coupler of said first arm of said first tier to said power and said second coupler of said first arm of said first tier to said first coupler of said second arm of said first tier;

operatively connecting said first tier second coupler of said second arm to said second tier first coupler of said first arm wherein power is delivered from said lead wire, to said first tier, and from said first tier to said second tier.

9. The lighting system according to claim 1 wherein said first coupler is a male coupler and said second coupler is a female coupler.

* * * * *